US007946880B2

(12) United States Patent
Tsai et al.

(10) Patent No.: US 7,946,880 B2
(45) Date of Patent: May 24, 2011

(54) ELECTRONIC CONNECTOR ASSEMBLY

(75) Inventors: Lung-Sheng Tsai, Taipei Hsien (TW); Chia-Kang Wu, Taipei Hsien (TW); Li-Ping Chen, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/566,697

(22) Filed: Sep. 25, 2009

(65) Prior Publication Data

US 2011/0021063 A1 Jan. 27, 2011

(30) Foreign Application Priority Data

Jul. 23, 2009 (CN) ..... 2009 1 0304718

(51) Int. Cl.
*H01R 13/00* (2006.01)

(52) U.S. Cl. ..... 439/484; 439/358

(58) Field of Classification Search ..... 439/484, 439/358, 483

See application file for complete search history.

(56) References Cited

U.S. PATENT DOCUMENTS

| | | | | |
|---|---|---|---|---|
| 6,126,479 | A * | 10/2000 | Lee | 439/484 |
| 6,416,353 | B1 * | 7/2002 | Hwang et al. | 439/484 |
| 6,500,023 | B1 * | 12/2002 | Duong et al. | 439/484 |
| D482,333 | S * | 11/2003 | Hisamatsu et al. | D13/147 |
| 6,749,458 | B1 * | 6/2004 | Kuo et al. | 439/484 |
| 6,855,000 | B2 * | 2/2005 | Wu | 439/484 |
| 2002/0072267 | A1 * | 6/2002 | Bowling et al. | 439/358 |
| 2003/0139082 | A1 * | 7/2003 | Aramoto et al. | 439/358 |

* cited by examiner

*Primary Examiner* — Hien Vu
(74) *Attorney, Agent, or Firm* — Frank R. Niranjan

(57) ABSTRACT

An electronic connector assembly includes a first connector, a second connector, and a handle. The first connector includes a main portion and two shoulders. Each shoulder defines a groove. The main portion forms at least one wedge thereon. The second connector defines at least one securing hole, which receives the at least one wedge positioned therein. The handle includes a cord and two securing portions formed on opposite ends of the cord. The two securing portions are secured in the grooves of the two shoulders of the first connector to mount the handle on the first connector. The handle is capable of being pulled to disengage the first connector from the second connector.

8 Claims, 3 Drawing Sheets

ELECTRONIC CONNECTOR ASSEMBLY

BACKGROUND

1. Technical Field

The present disclosure relates to electronic connectors, and particularly to a detachable electronic connector assembly.

2. Description of Related Art

Connectors are widely used to transmit signals between different electronic components. For transmitting signals between two electronic components, two connectors, tightly connected, are generally employed. It can be difficult to separate the two connectors if one or both of the connectors needs to be detached. Typically, a user has to pry one of the connector back and forth to work it loose from the other which can damage pins of the connectors.

Therefore, there is room for improvement in the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
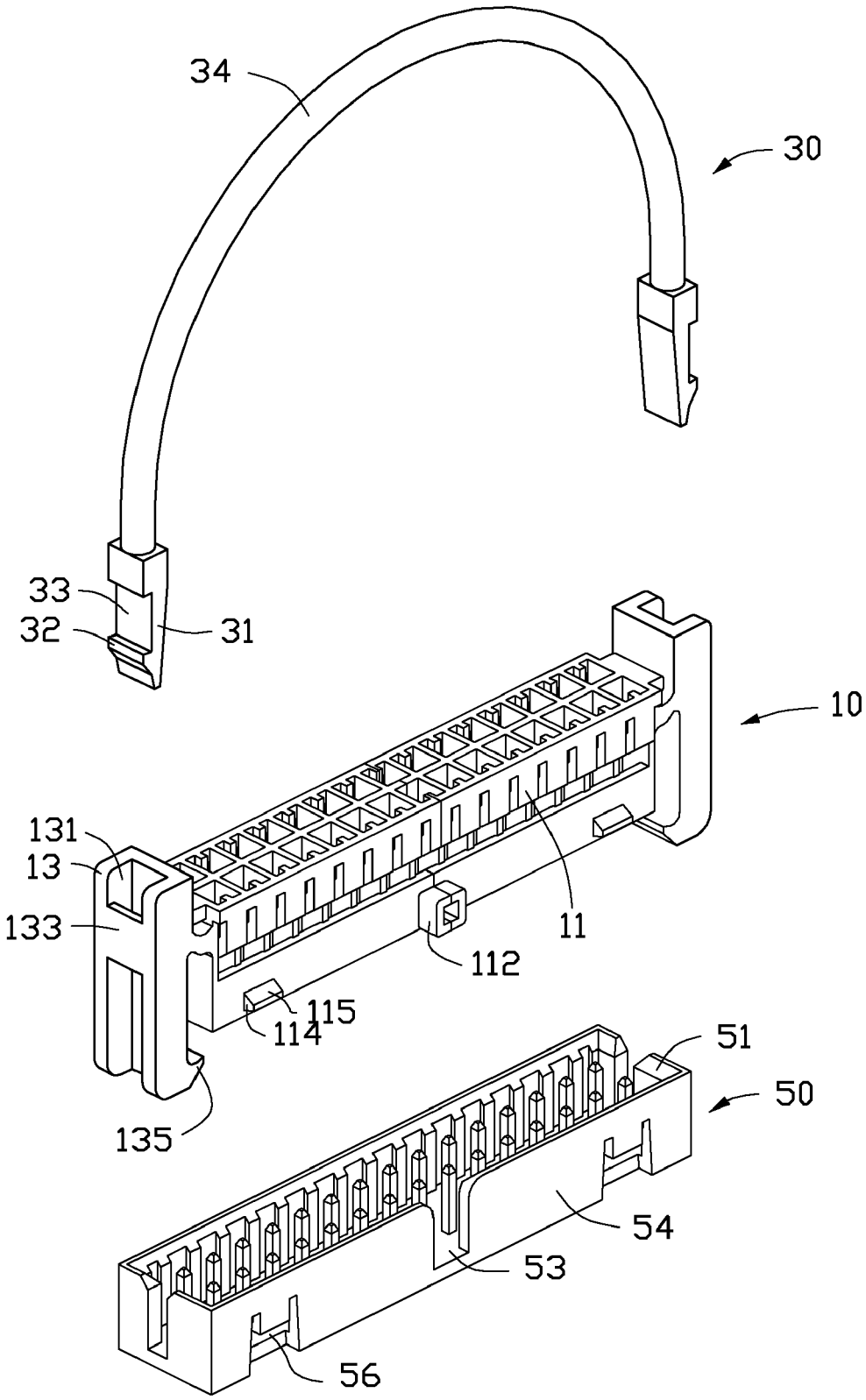
FIG. 1 is an exploded, isometric view of an embodiment of an electronic connector assembly.

Referring to FIG. 1, an electronic connector assembly, in accordance with an embodiment, includes a first connector 10, a second connector 50, and a handle 30 adapted to be mounted on the first connector 10.

The first connector 10 includes a main portion 11 and two shoulder 13 formed on two sides of the main portion 11. A pair of flexible wedges 114 is formed on the main portion 11. A position block 112 is formed on the main portion 11, and located between the pair of wedges 114. A top surface and a bottom surface of each wedge 114 respectively form a slant surface 115 thereon. Each shoulder 13 defines a groove 131 extending in an up and down (vertical) direction. A retaining piece 133 bridges the groove 131. A hook 135 is formed on a bottom end of the shoulder 13.

The second connector 50 includes a frame 51, which includes an upright sidewall 54. The sidewall 54 defines a position slot 53 corresponding to the position block 112 of the first connector 10. A pair of securing holes 56 is defined in the sidewall 54 corresponding to the pair of wedges 114 of the first connector 10.

The handle 30 includes a flexible cord 34 and a pair of securing portions 31 formed on opposite ends of the cord 34. Each securing portion 31 forms a clasp 32 thereon. A recess 33 is defined in the securing portion 31 adjacent to the clasp 32.

Figure 2:
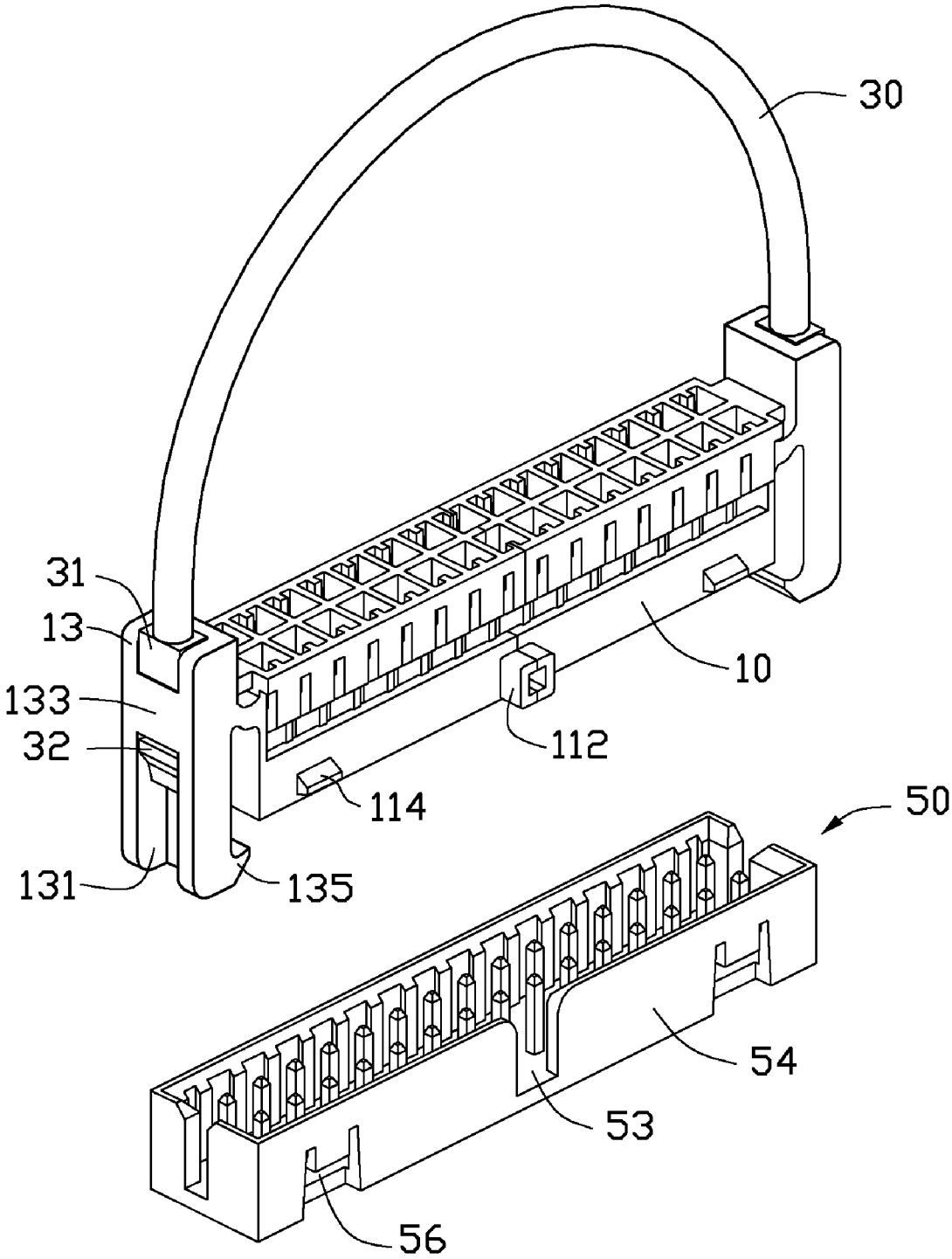
FIG. 2 is a part-assembled view of the electronic connector assembly of FIG. 1.
Figure 3:
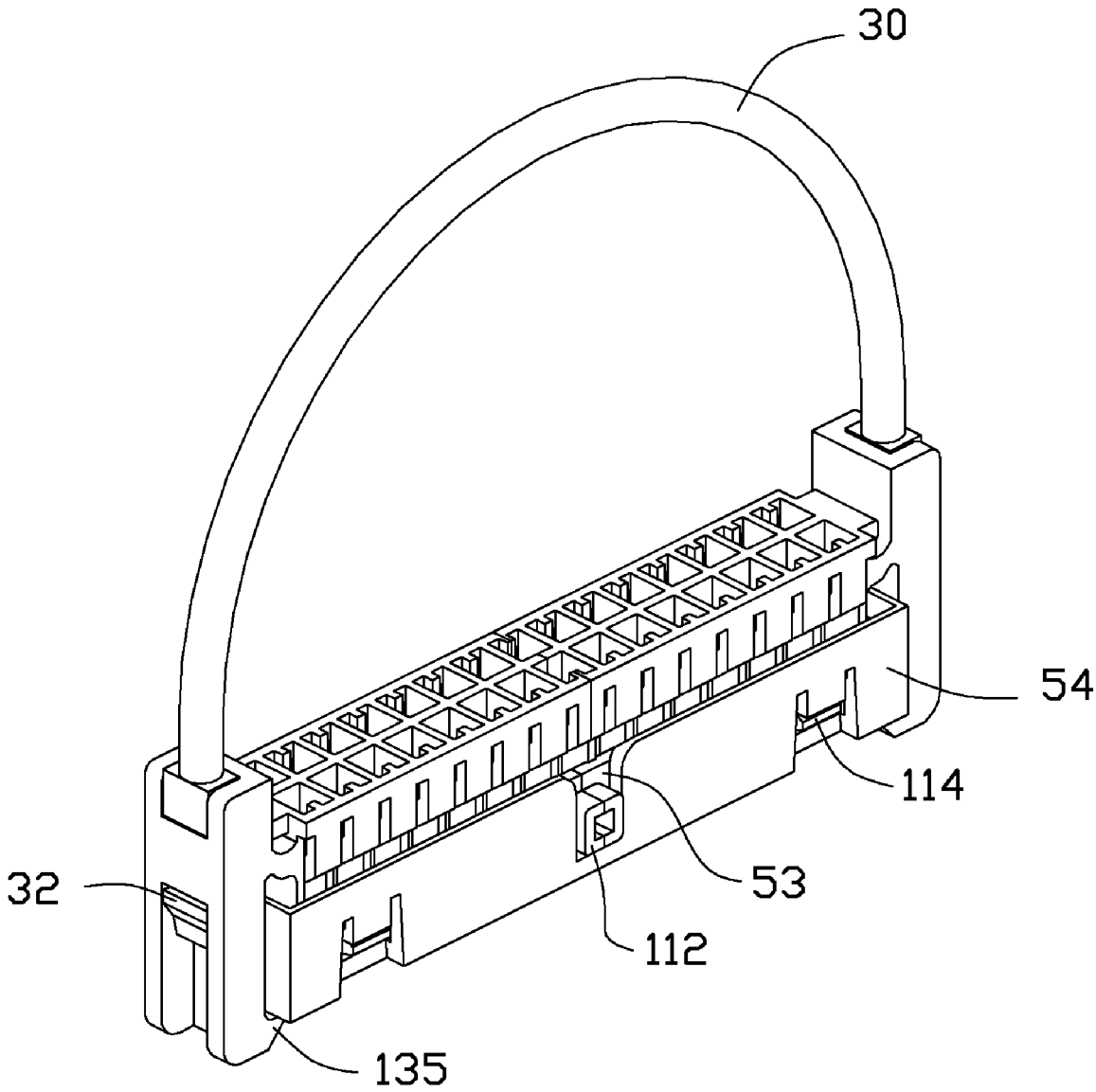
FIG. 3 is an assembled view of the electronic connector assembly of FIG. 1.

Referring to FIGS. 1 to 3, to mount the handle 30 on the first connector 10, the pair of securing portions 31 of the handle 30 slide into the two grooves 131 of the first connector 10. Each clasp 32 is depressed by the corresponding retaining piece 133. The securing portion 31 slides until the clasp 32 slides under and past the retaining piece 133. At this position, the clasp 32 rebounds to secure the handle 30 on the first connector 10. Simultaneously, the retaining piece 133 is embedded in the recess 33.

The first connector 10 is then moved toward the second connector 50. The position block 112 of the first connector 10 slides in the position slot 53 of the second connector 20. The sidewall 54 of the second connector 50 abuts and deforms the wedges 114 of the first connector 10. The first connector 10 is moved relative to the second connector 50 until the wedges 114 of the first connector 10 are in alignment with the securing holes 56 of the second connector 50. The wedges 114 then rebound to be inserted in the securing holes 56. Simultaneously, the hooks 135 of the first connector 10 are clasped on a bottom side of the second connector 50. Thereby, the first connector 10 and the second connector 20 are coupled together.

To detach the first connector 10 from the second connector 50, upper portions of the shoulders 13 of the first connector 10 are pressed toward each other. The shoulders 13 of the first connector 10 are bent. The hooks 135 of the first connector 10 uncouple from the bottom side of the second connector 50. Then, the cord 34 of the handle 30 is pulled. The slant surfaces 115 of the wedges 114 guide the wedges 114 to slide out of the securing holes 56 of the second connector 50. The cord 34 of the handle 30 is pulled until the first connector 10 is detached from the second connector 50.

It is to be understood, however, that even though numerous characteristics and advantages of the embodiments have been set forth in the foregoing description, together with details of the structure and function of the embodiments, the disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An electronic connector assembly, comprising:

a first connector comprising a main portion and two shoulders, each shoulder defining a groove, the main portion forming at least one wedge thereon;

a second connector defining at least one securing hole on a sidewall thereof, the at least one securing hole receiving the at least one wedge positioned therein; and a handle comprising a cord and two securing portions formed on opposite ends of the cord, the two securing portions secured in the grooves of the two shoulders of the first connector to mount the handle on the first connector, the handle capable of being pulled to disengage the first connector from the second connector;

wherein the at least one wedge comprises two wedges, a position block is formed on the main portion between the two wedges and the at least one securing hole comprising two securing holes for receiving the two wedges in the two securing holes, the second connector defines a position slot, the position slot receives the position block sliding therein.

2. The electronic connector assembly of claim 1, wherein a bottom end of each shoulder forms a hook, the hook clasps a bottom side of the second connector.

3. The electronic connector assembly of claim 1, wherein a retaining piece bridges two sides of each groove, each securing portion forms a clasp which is clasped on the retaining piece.

4. The electronic connector assembly of claim 3, wherein a recess is defined in the securing portion adjacent the clasp, the retaining piece is embedded in the recess.

5. The electronic connector assembly of claim 1, wherein a surface of the at least one wedge forms a slant surface capable of guiding the at least one wedge sliding out of the at least one securing hole.

6. An electronic connector assembly, comprising:

a first connector comprising two shoulders, each of the shoulders defining a groove, a retaining piece bridged two sides of the groove;

a handle comprising a cord having two securing portions formed thereon, each of the securing portions having a clasp and a recess adjacent the clasp; wherein the securing portion slides in the groove to have the clasp sliding over the retaining piece and clasping on the retaining piece, the retaining piece is embedded in the recess; and a second connector, wherein the second connector defines two securing holes on a sidewall thereof, the first connector comprises two wedges capable of being inserted in the two securing holes when the first connector is coupled with the second connector, each of the wedges forms a slant surface configured to guide the wedge sliding out of each of the securing holes when the first connector is detached from the second connector.

7. The electronic connector assembly of claim 6, wherein a bottom end of the shoulder forms a hook capable of clasping on a bottom side of the second connector when the first connector is coupled with the second connector.

8. The electronic connector assembly of claim 6, further comprising a second connector, wherein a position block is formed on the first connector, the second connector defines a position slot capable of receiving the position block sliding therein.

* * * * *